US011204563B2

(12) United States Patent
Matsumoto et al.

(10) Patent No.: US 11,204,563 B2
(45) Date of Patent: Dec. 21, 2021

(54) IMAGE FORMING APPARATUS

(71) Applicant: FUJIFILM Business Innovation Corp., Tokyo (JP)

(72) Inventors: Mitsuhiro Matsumoto, Kanagawa (JP); Yutaka Kiuchi, Kanagawa (JP); Tokuya Sakamoto, Kanagawa (JP); Tetsuro Kodera, Kanagawa (JP); Masayo Higashimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 20 days.

(21) Appl. No.: 16/535,468

(22) Filed: Aug. 8, 2019

(65) Prior Publication Data

US 2020/0301305 A1 Sep. 24, 2020

(30) Foreign Application Priority Data

Mar. 22, 2019 (JP) ..... JP2019-055554

(51) Int. Cl.
*G03G 15/01* (2006.01)
*G03G 15/00* (2006.01)

(52) U.S. Cl.
CPC ..... *G03G 15/0184* (2013.01); *G03G 15/652* (2013.01); *G03G 2215/00679* (2013.01); *G03G 2215/0122* (2013.01)

(58) Field of Classification Search
CPC ..... G03G 15/652; G03G 15/5029
See application file for complete search history.

(56) References Cited

U.S. PATENT DOCUMENTS 4,962,387 A * 10/1990 Yamamoto ..... B41J 2/325 347/176
9,690,239 B2 6/2017 Ui et al.
2010/0108733 A1* 5/2010 Fuwa ..... B65H 23/1888 226/1
2013/0214023 A1* 8/2013 de Jong ..... B41J 11/42 226/1
2017/0308012 A1* 10/2017 Kibayashi ..... G03G 15/2028
2018/0101118 A1* 4/2018 Hiroe ..... G03G 15/657
2018/0282103 A1* 10/2018 Sato ..... B65H 43/00

FOREIGN PATENT DOCUMENTS

JP 2016-180925 A 10/2016
JP 2018-016431 A 2/2018

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An image forming apparatus includes: a transfer unit that faces an image holding unit and is configured to come into contact with and separate from the image holding unit with a continuous form paper continuous in a transport direction interposed between the transfer unit and the image holding unit and to transfer an image held by the image holding unit onto the continuous form paper; a displacement unit that displaces the continuous form paper to a position closer to the image holding unit when the transfer unit separates from the image holding unit; and a contact portion that contacts the continuous form paper from a downstream side in a displacement direction before the continuous form paper displaced by the displacement unit contacts the image holding unit.

11 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2019-055554 filed Mar. 22, 2019.

BACKGROUND

(i) Technical Field

The present disclosure relates to an image forming apparatus.

(ii) Related Art

As a related art, JP-A-2018-16431 (Patent Document 1) discloses an image forming apparatus that forms an image onto a continuous sheet.

A certain image forming apparatus that forms an image onto a continuous form paper continuous in a transport direction is configured such that when an image forming operation is stopped, a transfer unit is separated from an image holding unit and the continuous form paper is displaced so as to approach the image holding unit. When displaced, the continuous form paper may come in contact with the surface of the image holding unit to cause a damage to the surface of the image holding unit.

SUMMARY

Aspects of non-limiting embodiments of the present disclosure relates to preventing a continuous form paper from coming into contact with an image holding unit when the continuous form paper is displaced, in contrast to a case where there is no member provided to limit the displacement of the continuous form paper.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a transfer unit that faces an image holding unit and is configured to come into contact with and separate from the image holding unit with a continuous form paper continuous in a transport direction interposed between the transfer unit and the image holding unit and to transfer an image held by the image holding unit onto the continuous form paper; a displacement unit that displaces the continuous form paper to a position closer to the image holding unit when the transfer unit separates from the image holding unit; and a contact portion that contacts the continuous form paper from a downstream side in a displacement direction before the continuous form paper displaced by the displacement unit contacts the image holding unit.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present disclosure will be described in detail with reference to accompanying drawings.

Exemplary Embodiment 1

Figure 1:
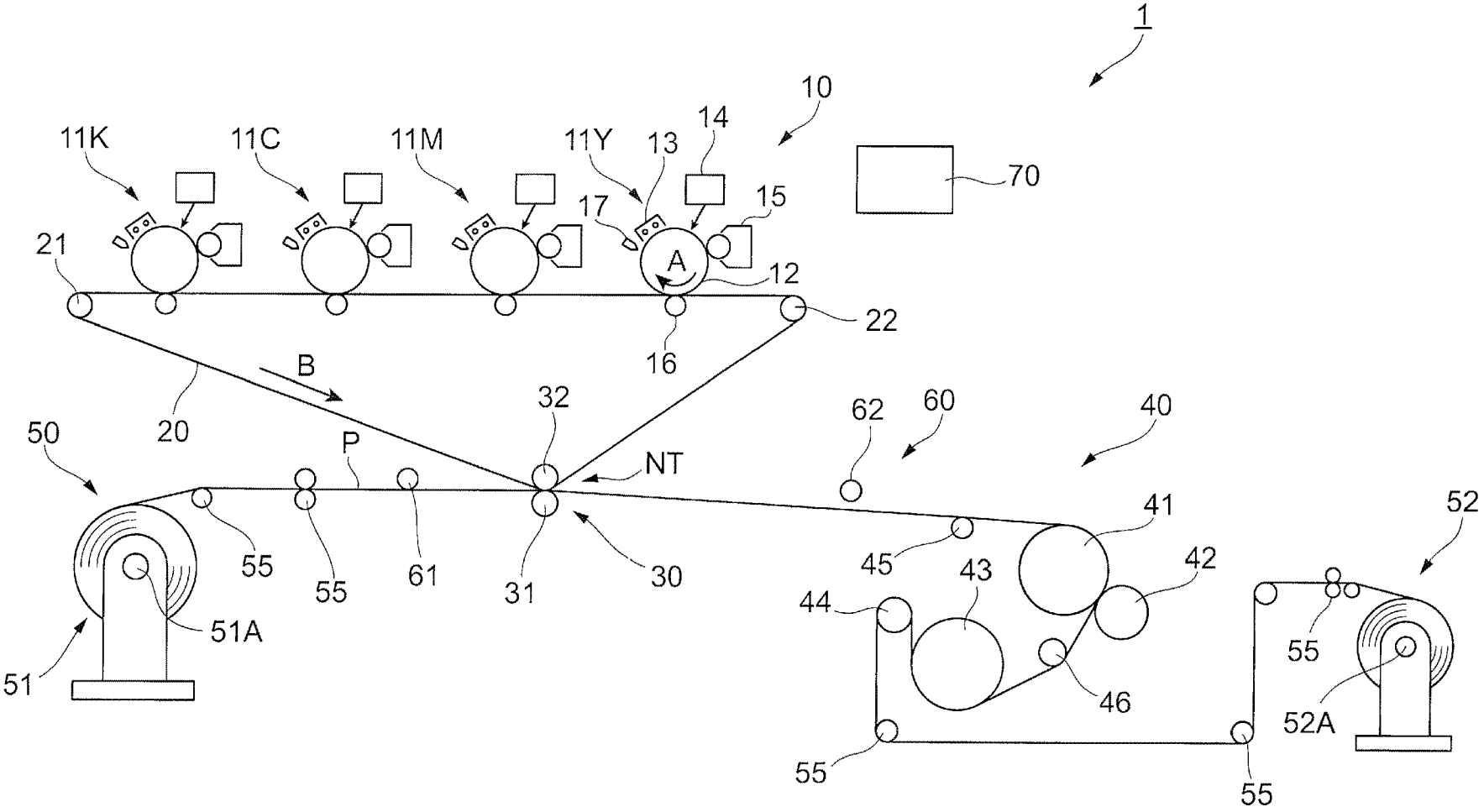
FIG. 1 is a diagram illustrating an entire configuration of an image forming apparatus to which Exemplary Embodiment 1 is applied.

FIG. 1 is a diagram illustrating an entire configuration of an image forming apparatus 1 to which Exemplary Embodiment 1 is applied. In the following description, a direction from top to bottom in FIG. 1 may be referred to as a vertical direction.

The image forming apparatus 1 form an image on continuous form paper P while transporting the continuous form paper P in a predetermined transport direction. The continuous form paper P is an elongated recording medium continuous in the transport direction. As illustrated in FIG. 1, the image forming apparatus 1 includes an image forming section 10 that forms an image on the continuous form paper P, a fixing unit 40 that fixes the image formed by the image forming section 10 onto the continuous form paper P, a transport unit 50 that transports the continuous form paper P, a guide unit 60 that guides the continuous form paper P to be transported by the transport unit 50, and a control unit 70 that controls each unit of the image forming apparatus 1.

The image forming section 10 includes plural (four in the present exemplary embodiment) image forming units 11 (specifically, image forming units 11Y, 11M, 11C, and 11K) that form each color toner image by an electrophotographic process, an intermediate transfer belt 20 as an example of an image holding unit for primarily transferring and holding each color toner image formed by each of the image forming units 11, and a secondary transfer device 30 that secondarily transfers a superimposed toner image primarily transferred to the intermediate transfer belt 20 to paper as an example of a recording material.

Each of the image forming units 11, that is, each of the yellow (Y) image forming unit 11Y, the magenta (M) image forming unit 11M, the cyan (C) image forming unit 11C, and the black (K) image forming unit 11K has a common configuration except for the color of toner.

Each of the image forming units 11 includes a photosensitive drum 12 which is rotatably provided in an arrow A direction. In addition, each of the image forming units 11 includes a charger 13, an exposure unit 14, a developer 15, a primary transfer roll 16, and a drum cleaner 17 which are provided around the photosensitive drum 12 along the arrow A direction.

The intermediate transfer belt 20 is stretched rotatably around tension rolls 21 and 22. Among the tension rolls 21 and 22, the tension roll 22 stretches the intermediate transfer belt 20 and rotationally drives the intermediate transfer belt 20 in an arrow B direction. In addition, the other tension roll 21 rotates following the intermediate transfer belt 20 driven by the tension roll 22.

The secondary transfer device 30 includes a secondary transfer roll 31 and a backup roll 32 which face each other by interposing the intermediate transfer belt 20. The secondary transfer roll 31 is an example of the transfer unit and is provided on the outer peripheral surface side of the intermediate transfer belt 20, and the backup roll 32 is provided on the inner peripheral surface side of the intermediate transfer belt 20. In addition, the secondary transfer roll 31 is in a state of being pressed against the backup roll 32 at a predetermined pressure via the intermediate transfer belt 20. The secondary transfer device 30 transfers the toner image held on the intermediate transfer belt 20 onto the surface of the continuous form paper P by a secondary transfer electric field formed between the secondary transfer roll 31 and the backup roll 32 and the pressure formed between the secondary transfer roll 31 and the backup roll 32. In the following description, a position where the toner image is transferred onto the continuous form paper P, that is a position where the secondary transfer roll 31 faces the backup roll 32 with the intermediate transfer belt 20 interposed therebetween may be described as a secondary transfer position NT. The secondary transfer position NT is an example of the facing position.

In addition, in the secondary transfer device 30 of the present exemplary embodiment, for example, when an image forming operation on the continuous form paper P is stopped in the image forming apparatus 1, the pressing of the secondary transfer roll 31 against the backup roll 32 is released by separating the secondary transfer roll 31 from the backup roll 32. In this example, the secondary transfer roll 31 is moved downward to the backup roll 32 in a vertical direction and is separated from the backup roll 32. Accordingly, the secondary transfer roll 31 and the continuous form paper P are separated from the intermediate transfer belt 20.

The fixing unit 40 fixes the toner image transferred by the secondary transfer device 30 onto the continuous form paper P. The fixing unit 40 includes a preheating roll 41 as an example of a heating unit facing and interposing the continuous form paper P and a fixing roll 42. In addition, the fixing unit 40 includes a first cooling roll 43 and a second cooling roll 44 that cool the continuous form paper P by contacting the continuous form paper P passed through the facing portion of the preheating roll 41 and the fixing roll 42. Furthermore, the fixing unit 40 includes a displacement roll 45 as an example of the displacement unit that displaces the continuous form paper P when the image forming operation is stopped in the image forming apparatus 1, for example. Furthermore, the fixing unit 40 includes a support roll 46 that contacts the back surface of the continuous form paper P between the preheating roll 41 and the first cooling roller 43 and supports the continuous form paper P.

A configuration and an operation of the fixing unit 40 will be described in detail later.

The transport unit 50 stretches and transports the continuous form paper P in the image forming apparatus 1. The transport unit 50 includes a paper feeding device 51 that feeds the continuous form paper P to the image forming section 10 and a collection device 52 that collects the continuous form paper P after the image is formed in the image forming section 10. In addition, the transport unit 50 includes plural transport rolls 55 that transport the continuous form paper P in contact with the continuous form paper P.

The paper feeding device 51 feeds the continuous form paper P wound in a roll shape to the image forming section 10 while rewinding the continuous form paper P. Specifically, the paper feeding device 51 includes a roll member 51A that supports the continuous form paper P wound in a roll shape and is rotatable. By rotating the roll member 51A clockwise, the continuous form paper P wound in a roll shape is rewound and the continuous form paper P is fed to the image forming section 10.

The collection device 52 collects the continuous form paper P on which the image is formed in the image forming section 10 while winding the continuous form paper P into a roll. Specifically, the collection device 52 includes a roll member 52A that is rotatable. In the collection device 52, when the roll member 52A is rotated clockwise by a drive device (not illustrated), the continuous form paper P is wound around the outer periphery of the roll member 52A. Accordingly, the continuous form paper P is pulled and pulled out from the roll member 51A of the paper feeding device 51. In addition, in the image forming apparatus 1, the continuous form paper P is transported in the transport direction from left to right in FIG. 1.

The guide unit 60 guides the continuous form paper P so that the continuous form paper P does not contact the intermediate transfer belt 20 when the continuous form paper P is displaced due to the displacement roll 45 of the fixing unit 40. The guide unit 60 includes an upstream contact roll 61 as an example of a second contact portion contacting the surface of the continuous form paper P upstream of the secondary transfer position NT in the direction of transport of the continuous form paper P. In addition, the guide unit 60 includes a downstream contact roll 62 as an example of a contact portion that contact the surface of the continuous form paper P or a limiting unit downstream of the secondary transfer position NT in the direction of transport of the continuous form paper P at least when the continuous form paper P is displaced by the displacement roll 45.

The upstream contact roll 61 and the downstream contact roll 62 are formed of resin materials or metal materials and include roll members supported rotatably. In addition, a release layer formed of, for example, a fluorine resin may be formed on the outer peripheral surfaces of the upstream contact roll 61 and the downstream contact roll 62.

The guide unit 60 will be described in detail later.

The control unit 70 includes a central processing unit (CPU), a read only memory (ROM), a random access memory (RAM), and a hard disk drive (HDD) (all not illustrated). A process program is executed in the CPU. Various types of programs, various types of tables, parameters, or the like are stored in the ROM. The RAM is used as a work area or the like when the various types of programs are executed by the CPU.

Subsequently, the image forming operation performed by the image forming apparatus 1 of the present exemplary embodiment will be described. The image forming operation described below is executed under the control of the control unit 70.

With the start of the image forming operation, the control unit 70 performs an image process on image data formed by a personal computer (not illustrated) or the like. In addition, the rotation of each of the photosensitive drum 12 and the intermediate transfer belt 20 of the image forming section 10 is started based on the control by the control unit 70. Furthermore, in the fixing unit 40, power supply to a heater of the preheating roll 41 and the fixing roll 42 is started.

The surface of each photosensitive drum 12 is charged to a predetermined potential by the charger 13 and exposed by the exposure unit 14 based on the image data subjected to the image process. Accordingly, electrostatic latent images of respective colors are formed on the photosensitive drums 12, respectively. Color toner images of black (K), yellow (Y), magenta (M), and cyan (C) are formed on the photosensitive drums 12, respectively.

The color toner images respectively formed on the photosensitive drums 12 are sequentially electrostatically attracted by the primary transfer roll 16 onto the moving intermediate transfer belt 20 to form a composite toner image in which the color toner images are superimposed. The composite toner image on the intermediate transfer belt 20 is transported to the secondary transfer position NT in accordance with the movement of the intermediate transfer belt 20.

When the composite toner image is transported to the secondary transfer position NT, at the timing when the composite toner image is transported to the secondary transfer position NT, the continuous form paper P is transported toward the secondary transfer roll 31 by the paper feeding device 51 and a transport roll 55. Accordingly, the composite toner image is collectively electrostatically transferred to a predetermined region on the continuous form paper P by the action of the secondary transfer electric field formed between the secondary transfer roll 31 and the backup roll 32.

Subsequently, a region where the composite toner image is formed in the continuous form paper P is transported to the fixing unit 40 after the region is separated from the intermediate transfer belt 20 transported by the rotating secondary transfer roll 31. In the fixing unit 40, the fixing process is performed using heat and pressure by the preheating roll 41 and the fixing roll 42 and a color image is formed on the continuous form paper P. Subsequently, the region where the color image is formed in the continuous form paper P is cooled by the first cooling roll 43 and the second cooling roll 44.

Thereafter, the region where the color image is formed in the continuous form paper P is discharged from the fixing unit 40 and is wound by the roll member 52A of the collection device 52 and collected.

In addition, when the image forming operation of the image forming apparatus 1 is stopped, the following processes are performed under the control of the control unit 70.

First, with the stop of the image forming operation, the transport of the continuous form paper P by the transport unit 50 is stopped and the rotation of each of the photosensitive drum 12 and intermediate transfer belt 20 of the image forming section 10 is stopped. In addition, power supply to the preheating roll 41 of the fixing unit 40 and the heater of the fixing roll 42 is stopped.

Subsequently, the secondary transfer roll 31 is moved downward in the vertical direction and is separated from the backup roll 32 and the intermediate transfer belt 20. Further, in the fixing unit 40, the fixing roll 42 is separated from the preheating roll 41.

Next, the continuous form paper P is transported by the transport unit 50 and a region where the image is already formed in the continuous form paper P (for example, a region where an unfixed toner image is formed by the image forming section 10) is discharged from the image forming section 10 and the fixing unit 40.

Thereafter, the displacement roll 45 is moved in the fixing unit 40 and the continuous form paper P is displaced.

Figure 2:
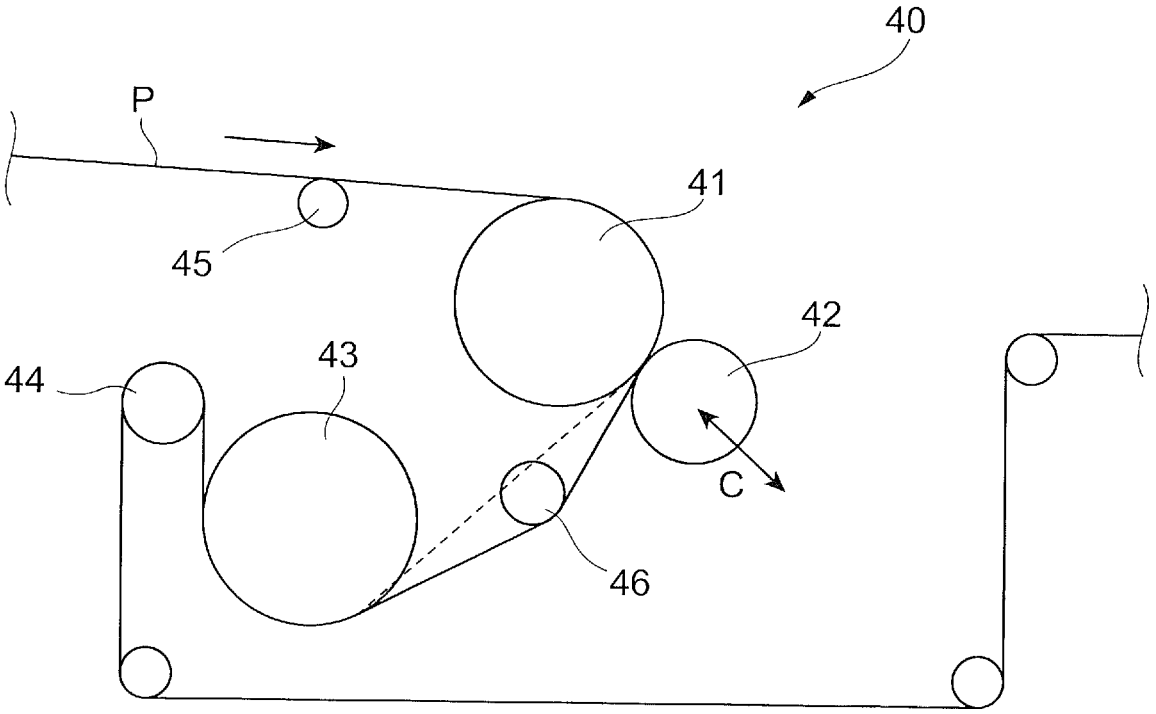
FIG. 2 is a diagram illustrating a fixing unit to which Exemplary Embodiment 1 is applied.

Subsequently, the configuration of the fixing unit 40 according to the present exemplary embodiment will be described in detail. FIG. 2 is a diagram illustrating the fixing unit 40 to which Exemplary Embodiment 1 is applied. Here, FIG. 2 illustrates the fixing unit 40 in a case of performing the image forming operation to the continuous form paper P in the image forming apparatus 1, that is, the fixing unit 40 before the continuous form paper P is displaced by the displacement roll 45.

As described above, the fixing unit 40 includes the preheating roll 41 that contacts the back surface that is a surface opposite to an image forming surface of the continuous form paper P on which the image is formed in the image forming section 10 and heats the continuous form paper P. As illustrated in FIG. 2, in a state before the continuous form paper P is displaced by the displacement roll 45, the preheating roll 41 is wound around the outer peripheral surface such that the continuous form paper P continuously contacts the roll in the circumferential direction.

In addition, the fixing unit 40 includes the fixing roll 42 that faces the preheating roll 41 interposing the continuous form paper P and heats the continuous form paper P from the surface side that is an image forming surface. The fixing roll 42 faces the preheating roll 41 on the downstream side in the direction of transport of the continuous form paper P among the region where the continuous form paper P is wound around the outer peripheral surface of the preheating roll 41.

The fixing roll 42 is configured to move in an arrow C direction with respect to the preheating roll 41 and to come into contact with and separate from the preheating roll 41. The fixing unit 40 is configured to be switched between a pressed state where the fixing roll 42 is pressed against the preheating roll 41 and a nip portion is formed between the fixing roll 42 and the preheating roll 41 and a release state where the pressing of the fixing roll 42 against the preheating roll 41 is released and the preheating roll 41 and the fixing roll 42 are separated from each other.

The preheating roll 41 and the fixing roll 42 include a cylindrical base body formed of a metal such as iron, aluminum, or SUS, for example, a heat-resistant elastic layer formed of a heat-resistant elastic material such as silicone rubber and formed on the outer periphery of the base body, and a release layer formed of a heat-resistant resin such as a fluorine resin or a silicone resin and formed on the surface of the heat-resistant elastic layer. In addition, the preheating roll 41 and the fixing roll 42 include a heater disposed on an inner periphery of the base body.

In addition, the fixing unit 40 includes the first cooling roll 43 that cools the continuous form paper P in contact with the back surface of the continuous form paper P passed through the nip portion and the second cooling roll 44 that cools the continuous form paper P in contact with the surface of the continuous form paper P downstream of the first cooling roll 43 in the direction of transport of the continuous form paper P. In this example, the continuous form paper P is wound so as to continuously contact the outer peripheral surfaces of the first cooling roll 43 and the second cooling roll 44 in the circumferential direction. In addition, the first cooling roll 43 and the second cooling roll 44 are driven following the continuous form paper P transported by the transport unit 50 (see FIG. 1). The first cooling roll 43 and the second cooling roll 44 include, for example, cylindrical rolls formed of a metal such as aluminum having high thermal conductivity.

Furthermore, for example, in the image forming apparatus 1, the fixing unit 40 includes the displacement roll 45 for displacing the continuous form paper P when the image forming operation to the continuous form paper P is stopped. When the image forming operation is performed in the image forming apparatus 1, the displacement roll 45 is disposed so as to contact the back surface of the continuous form paper P upstream of the preheating roll 41 in the direction of transport of the continuous form paper P. In addition, although details thereof will be described below, when the image forming operation is not performed in the image forming apparatus 1, for example, the position of the displacement roll 45 with respect to the preheating roll 41 is moved based on the control by the control unit 70 after the fixing unit 40 is switched from the pressed state to the release state. Accordingly, the continuous form paper P stretched by the displacement roll 45 is displaced and the region in which the outer peripheral surface of the preheating roll 41 and the continuous form paper P contact in the circumferential direction is shortened. In this example, the continuous form paper P stretched by the displacement roll 45 is displaced and the continuous form paper P is separated from the outer peripheral surface of the preheating roll 41. In the present exemplary embodiment, the meaning of the displacement of the continuous form paper P is that the position where the continuous form paper P is stretched is changed and differs from that the continuous form paper P is moved in the transport direction by the transport unit 50 or the like.

Furthermore, the fixing unit 40 includes a support roll 46 that contacts the back surface of the continuous form paper P between the preheating roll 41 and the first cooling roller 43 and supports the continuous form paper P. The support roll 46 is disposed on a surface side of the continuous form paper P, that is, on a side where the fixing roll 42 is separated from the preheating roll 41 compared to the outer peripheral surfaces of the preheating roll 41 and the first cooling roll 43. When the displacement roll 45 is moved, the continuous form paper P is displaced in a state where the back surface contacts the support roll 46.

The displacement roll 45 and the support roll 46 are formed of a resin material or a metal material and include a roll member rotatably supported. In addition, the release layer formed of, for example, a fluorine resin may be formed on the outer peripheral surfaces of the displacement roll 45 and the support roll 46.

Figure 3A:
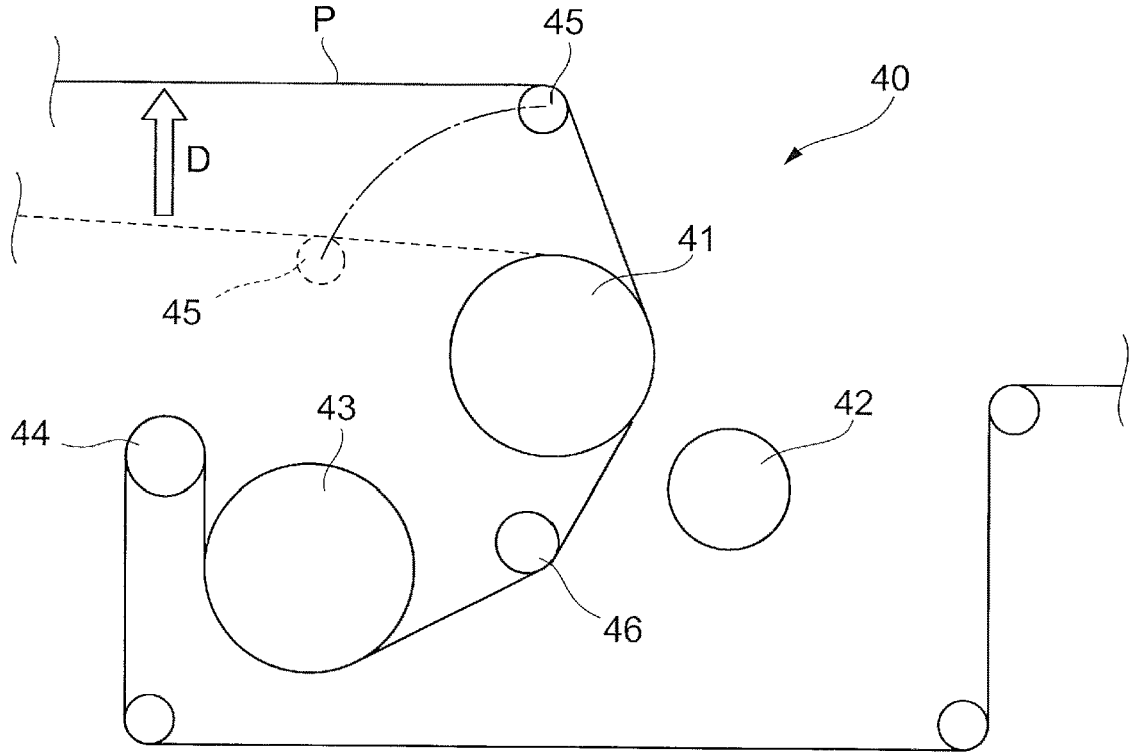
FIGS. 3A and 3B are diagrams for illustrating operations of the fixing unit.
Figure 3B:
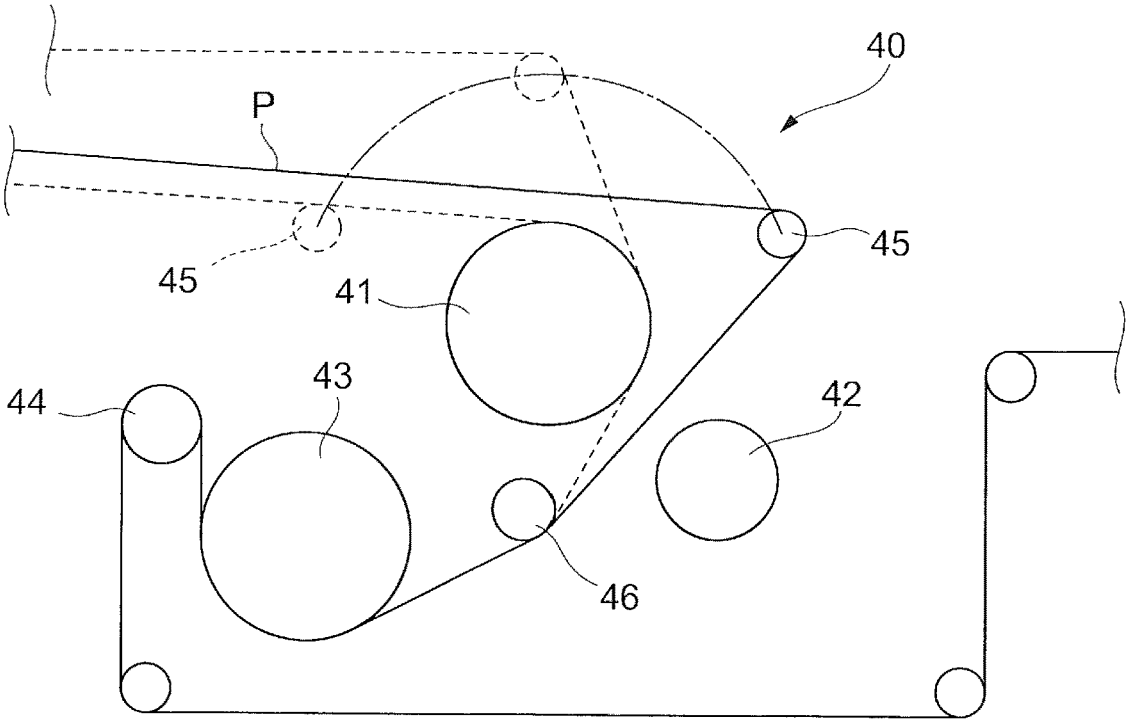

Subsequently, for example, the operation of the fixing unit 40 in a case where the image forming operation in the image forming apparatus 1 is stopped will be described. FIGS. 3A and 3B are diagrams for illustrating operations of the fixing unit 40. The operations of the fixing unit 40 proceed in order of FIGS. 3A and 3B. In addition, the following operations are performed based on the control by the control unit 70.

When the image forming operation in the image forming apparatus 1 is stopped, in the fixing unit 40, the power supply to the heaters of the preheating roll 41 and the fixing roll 42 is stopped. Thereafter, the fixing roll 42 is separated from the preheating roll 41 and the fixing unit 40 is switched to the release state. Specifically, as illustrated in FIG. 3A, the fixing roll 42 is moved in the lower right direction in the drawing so as to be separated from the preheating roll 41. Accordingly, a gap is formed between the preheating roll 41 and the fixing roll 42.

Next, the displacement roll 45 is moved to the preheating roll 41. Specifically, as illustrated in FIGS. 3A and 3B, the displacement roll 45 is moved around the preheating roll 41 about a predetermined fulcrum such that a locus of the movement is in the form of a circular arc having a diameter larger than that of the preheating roll 41. In addition, when focusing on the position in the vertical direction, after the displacement roll 45 is moved upward in the vertical direction as illustrated in FIG. 3A, the displacement roll 45 is moved downward in the vertical direction as illustrated in FIG. 3B.

When the displacement roll 45 is moved, the continuous form paper P stretched around the displacement roll 45 is displaced in a state where the tension is maintained. Specifically, as illustrated in FIG. 3A, the continuous form paper P stretched on the displacement roll 45 is moved upward in the vertical direction and the region where the outer peripheral surface of the preheating roll 41 and the continuous form paper P contact in the circumferential direction is shortened. Subsequently, as illustrated in FIG. 3B, the continuous form paper P stretched on the displacement roll 45 is moved to be separated from the preheating roll 41 with the support roll 46 as a fulcrum. Accordingly, as illustrated in FIG. 3B, the region where the outer peripheral surface of the preheating roll 41 and the continuous form paper P contact in the circumferential direction becomes shorter and the continuous form paper P is separated from the outer peripheral surface of the preheating roll 41. In addition, the continuous form paper P stretched between the displacement roll 45 and the support roll 46 is moved to the gap that is formed between the preheating roll 41 and the fixing roll 42.

As described above, in the fixing unit 40 of the present exemplary embodiment, for example, when the image forming operation is stopped, the continuous form paper P is displaced by the displacement roll 45 and separated from the preheating roll 41, so that the continuous form paper P is prevented from sticking to the preheating roll 41 due to the heat from the preheating roll 41 or the continuous form paper P is prevented from being damaged.

Here, when the displacement roll 45 is moved, as illustrated by an arrow D in FIG. 3A, the continuous form paper P stretched on the displacement roll 45 is displaced upward in the vertical direction compared to a state before the displacement roll 45 is moved. In other words, when the displacement roll 45 is moved, the continuous form paper P stretched on the displacement roll 45 is displaced to a position closer to the intermediate transfer belt 20 than the position before the displacement roll 45 is moved. Otherwise, if the continuous form paper P is displaced so as to approach the intermediate transfer belt 20, the continuous form paper P may contact the intermediate transfer belt 20 to cause a damage to the intermediate transfer belt 20.

In contrast, in the present exemplary embodiment, the continuous form paper P is guided by the guide unit 60, so that the continuous form paper P is prevented from contacting the intermediate transfer belt 20.

Figure 4A:
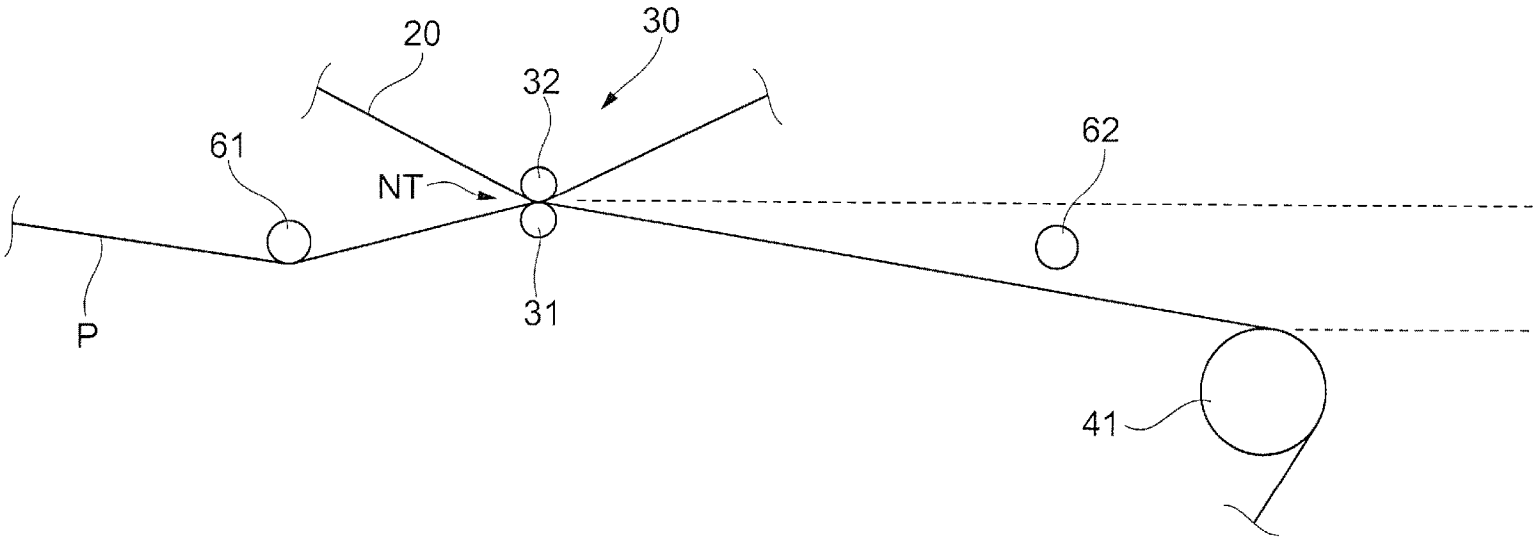
FIGS. 4A and 4B are diagrams for illustrating a positional relationship of members configuring a secondary transfer device, a fixing unit, and a guide unit.
Figure 4B:
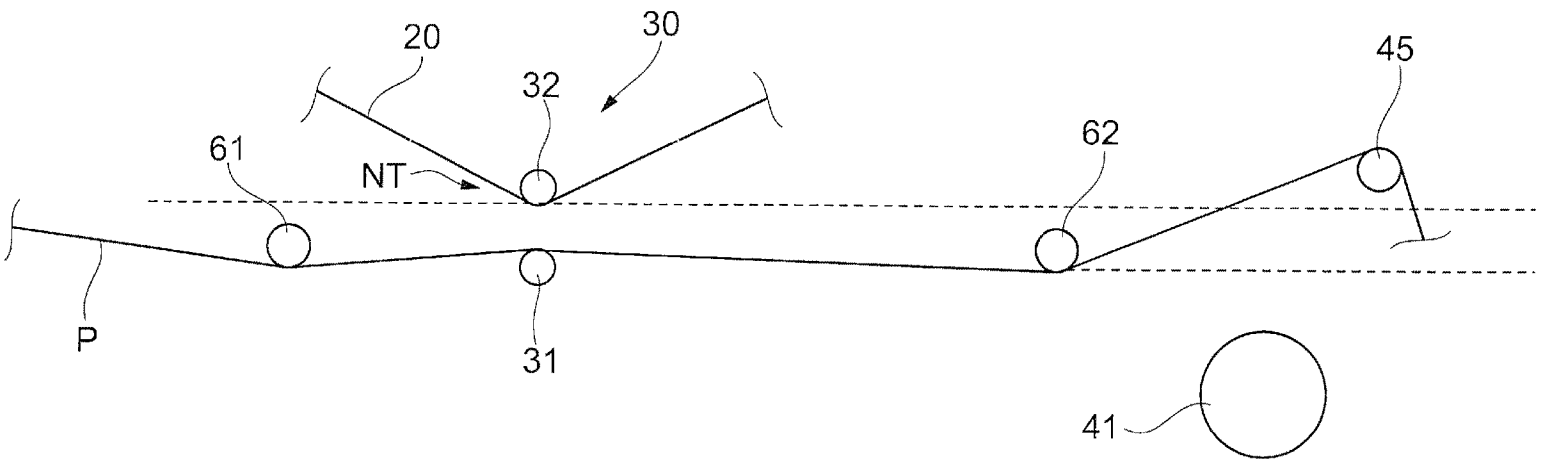

Subsequently, the positional relationship of the members configuring the secondary transfer device 30, the fixing unit 40, and the guide unit 60 will be described in detail. FIGS. 4A and 4B are diagrams for illustrating the positional relationship of the members configuring the secondary transfer device 30, the fixing unit 40, and the guide unit 60. FIG. 4A illustrates a case where the image forming operation is performed on the continuous form paper P, that is, a state before the continuous form paper P is displaced by the displacement roll 45. In addition, FIG. 4B illustrates, for example, a state where the image forming operation is stopped, the displacement roll 45 is moved to the position illustrated in FIG. 3A, and the continuous form paper P is displaced. Furthermore, FIGS. 4A and 4B illustrate the continuous form paper P, the secondary transfer roll 31 and the backup roll 32 of the secondary transfer device 30, the preheating roll 41 and the displacement roll 45 of the fixing unit 40, and the upstream contact roll 61 and the downstream contact roll 62 of the guide unit 60.

As illustrated in FIG. 4A, the preheating roll 41 of the fixing unit 40 is disposed below in the vertical direction compared to the secondary transfer position NT. Accordingly, the position at which the continuous form paper P contacts the outer peripheral surface of the preheating roll 41 is disposed below in the vertical direction compared to the secondary transfer position NT.

As described above, the upstream contact roll 61 of the guide unit 60 is provided upstream of the secondary transfer position NT in the direction of transport of the continuous form paper P. As illustrated in FIG. 4A, the upstream contact roll 61 is disposed below in the vertical direction compared to the secondary transfer position NT and disposed to be in contact with the surface of the continuous form paper P. Accordingly, the continuous form paper P is guided by the upstream contact roll 61 to enter from below in the vertical direction with respect to the secondary transfer position NT. In addition, the continuous form paper P is guided by the upstream contact roll 61 to enter from the secondary transfer roll 31 side with respect to the secondary transfer position NT.

As described above, the downstream contact roll 62 of the guide unit 60 is provided downstream of the secondary transfer position NT in the direction of transport of the continuous form paper P and upstream of the preheating roll 41 in the direction of transport of the continuous form paper P. As illustrated in FIG. 4A, the downstream contact roll 62 is disposed below the secondary transfer position NT in the vertical direction and is disposed above the preheating roll 41 in the vertical direction.

In addition, in a state where the continuous form paper P is not displaced by the displacement roll 45, as illustrated in FIG. 4A, the downstream contact roll 62 is disposed above the continuous form paper P in the vertical direction and does not contact the surface of the continuous form paper P. When the image forming operation is performed, the continuous form paper P of which the unfixed toner image is formed on the surface is transported between the secondary transfer position NT and the fixing unit 40. Therefore, the placement of the downstream contact roll 62 not in contact with the surface of the continuous form paper P prevents the downstream contact roll 62 from disturbing the unfixed toner image or prevents the toner from sticking to the downstream contact roll 62.

Subsequently, referring to FIG. 4B, the positional relationship of the members forming the secondary transfer device 30, the fixing unit 40, and the guide unit 60 in a state where the continuous form paper P is displaced by the displacement roll 45 will be described. As described above, for example, when the image forming operation is stopped, the displacement roll 45 is moved relative to the preheating roll 41 to displace the continuous form paper P after separating from the backup roll 32 and the intermediate transfer belt 20.

When the displacement roll 45 is moved relative to the preheating roll 41, the continuous form paper P is displaced upward in the vertical direction and in a direction to approach the intermediate transfer belt 20. The downstream contact roll 62 contacts the surface of the continuous form paper P. More specifically, the downstream contact roll 62 contacts the surface of the continuous form paper P from above in the vertical direction, that is, on the downstream side in the direction of displacement of the continuous form paper P.

In addition, the upstream contact roll 61 is disposed upstream of the secondary transfer position NT in the transport direction so as to contact the surface of the continuous form paper P.

Accordingly, in a region downstream of the upstream contact roll 61 in the transport direction and upstream of the downstream contact roll 62 in the transport direction, the displacement of the continuous form paper P is limited in a direction approaching the intermediate transfer belt 20.

As a result, even when the continuous form paper P is displaced by the displacement roll 45, the surface of the continuous form paper P is prevented from contacting the intermediate transfer belt 20.

As described above, for example, when the image forming operation is stopped and the continuous form paper P is displaced by the displacement roll 45, the region where the unfixed toner image is formed among the continuous form paper P is discharged from the fixing unit 40. Accordingly, even when the downstream contact roll 62 contacts the surface of the continuous form paper P, problems such as the disturbing of the toner image or adhering of the toner to the downstream contact roll 62 hardly occur.

In addition, in the image forming apparatus 1 of the present exemplary embodiment, when the upstream contact roll 61 contacts the surface of the continuous form paper P, the continuous form paper P enters from the secondary transfer roll 31 side relative to the secondary transfer position NT. However, in a case where the continuous form paper P enters from the secondary transfer roll 31 side with respect to the secondary transfer position NT due to the positional relationship between the transport roll 55 that transports the continuous form paper P and the secondary transfer position NT, the image forming apparatus 1 may not necessarily include the upstream contact roll 61.

Exemplary Embodiment 2

Figure 5:
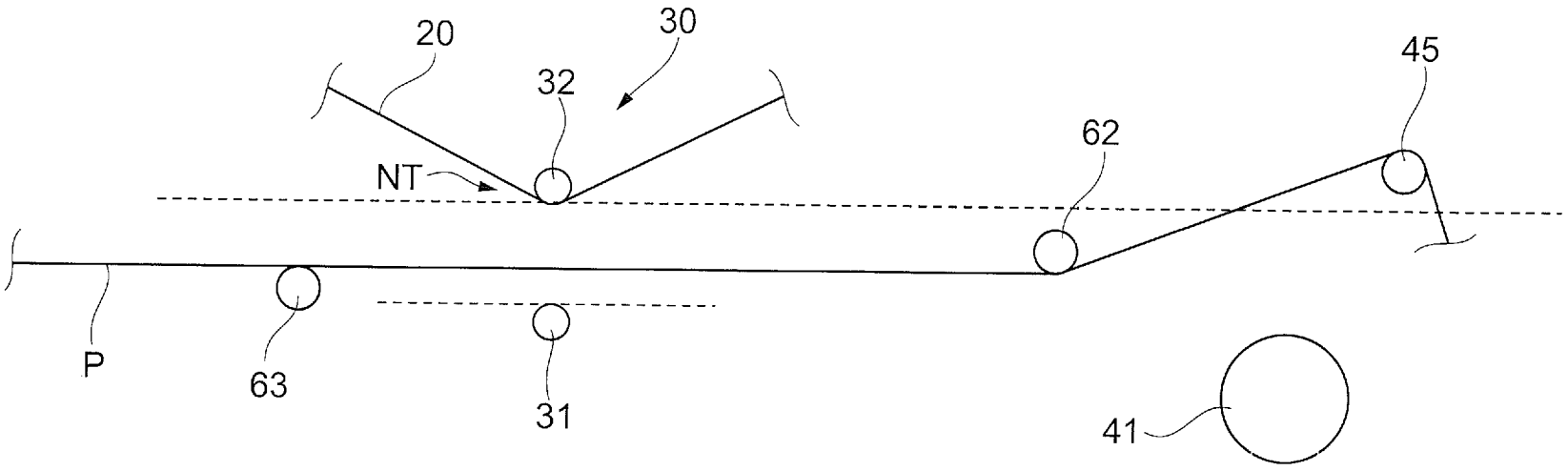
FIG. 5 is a diagram illustrating members configuring a secondary transfer device, a fixing unit, and a guide unit to which Exemplary Embodiment 2 is applied.

Subsequently, Exemplary Embodiment 2 of the present disclosure will be described. FIG. 5 is a diagram illustrating the members configuring the secondary transfer device 30, the fixing unit 40, and the guide unit 60 to which Exemplary Embodiment 2 is applied. FIG. 5 illustrates a state where, for example, the image forming operation is stopped, the displacement roll 45 is moved to the position illustrated in FIG. 3A, and the continuous form paper P is displaced.

The image forming apparatus 1 (see FIG. 1) of Exemplary Embodiment 2 includes an upstream contact roll 63 as an example of a third contact portion instead of the upstream contact roll 61 (see FIGS. 4A and 4B).

The upstream contact roll 63 is provided upstream of the secondary transfer position NT in the direction of transport of the continuous form paper P. In addition, as illustrated in FIG. 5, the upstream contact roll 63 is disposed below the secondary transfer position NT in the vertical direction and is disposed above the secondary transfer roll 31 separated from the backup roll 32 and the intermediate transfer belt 20 in the vertical direction.

In a case where secondary transfer roll 31 is separated from the backup roll 32 and the intermediate transfer belt 20 and the continuous form paper P is displaced due to the displacement roll 45, the upstream contact roll 63 contacts the back surface of the continuous form paper P.

Accordingly, in the present exemplary embodiment, the back surface of the continuous form paper P is prevented from contacting the secondary transfer roll 31. Thus, dirt or the like sticking to the surface of the secondary transfer roll 31 is prevented from sticking to the back surface of the continuous form paper P.

If the back surface of the continuous form paper P does not contact the secondary transfer roll 31 due to the positional relationship between the secondary transfer roll 31 and the downstream contact roll 62, the positional relationship between the transport roll 55 that transports the continuous form paper P and the secondary transfer position NT, the image forming apparatus 1 may not necessarily include the upstream contact roll 63.

As described above, although the exemplary embodiment of the present disclosure was described, the present disclosure is not limited to the exemplary embodiment described above.

The exemplary embodiment described above shows a case where the continuous form paper P is prevented from contacting the intermediate transfer belt 20 when the continuous form paper P is displaced in the fixing unit 40 provided downstream of the secondary transfer position NT in the transport direction. It will be understood that the above embodiment is non-limiting. For example, in the image forming apparatus 1, the present disclosure may also be applied to a case where the continuous form paper P is displaced upstream of the secondary transfer position NT in the transport direction for the purpose of maintenance or adjustment of the tension of the continuous form paper P. In a case where the continuous form paper P is displaced upstream of the secondary transfer position NT in the transport direction, a contact portion that contacts the continuous form paper P from the surface side and prevents contact between the continuous form paper P and the intermediate transfer belt 20 may be provided downstream of the displacement unit for displacing the continuous form paper P in the transport direction and upstream of the secondary transfer position NT in the transport direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit that faces an image holding unit and is configured to come into contact with and separate from the image holding unit with a continuous form paper continuous in a transport direction interposed between the transfer unit and the image holding unit and to transfer an image held by the image holding unit onto the continuous form paper;

a displacement unit configured to displace the continuous form paper to a position closer to the image holding unit when the transfer unit separates from the image holding unit; and a contact portion that contacts the continuous form paper from a downstream side in a displacement direction before the continuous form paper displaced by the displacement unit contacts the image holding unit.

2. The image forming apparatus according to claim 1, wherein the displacement unit displaces the continuous form paper downstream of the transfer unit in the transport direction, and the contact portion contacts the continuous form paper downstream of the transfer unit in the transport direction and upstream of the displacement unit in the transport direction.

3. The image forming apparatus according to claim 2, wherein when the displacement unit does not displace the continuous form paper, the contact portion does not contact the continuous form paper.

4. The image forming apparatus according to claim 2, further comprising:

a heating unit that is provided downstream of the transfer unit in the transport direction and contacts and heats the continuous form paper on which an image is transferred, wherein the displacement unit shortens a region where the heating unit and the continuous form paper contact each other by displacing the continuous form paper.

5. The image forming apparatus according to claim 2, wherein the continuous form paper enters, from the transfer unit side, a facing position at which the transfer unit and the image holding unit face each other.

6. The image forming apparatus according to claim 5, further comprising:

a second contact portion that is provided upstream of the transfer unit in the transport direction and contacts the continuous form paper from the downstream side in the displacement direction to cause the continuous form paper to enter, from the transfer unit side, the facing position.

7. The image forming apparatus according to claim 1, wherein when the transfer unit separates from the image holding unit, the transfer unit does not contact the continuous form paper displaced by the displacement unit.

8. The image forming apparatus according to claim 7, further comprising:

a third contact portion that is provided upstream of the transfer unit in the transport direction and prevents the continuous form paper from contacting the transfer unit by contacting the continuous form paper from an upstream side in the displacement direction when the transfer unit separates from the image holding unit.

9. The image forming apparatus according to claim 1, wherein the position closer to the image holding unit when the transfer unit separates from the image holding unit is a position downstream of the transfer unit.

10. An image forming apparatus comprising:

a transfer unit that faces an image holding unit and is configured to come into contact with and separate from the image holding unit with a continuous form paper continuous in a transport direction interposed between the transfer unit and the image holding unit and to transfer an image held by the image holding unit onto the continuous form paper;

a displacement unit configured to displace the continuous form paper to a position closer to the image holding unit when the transfer unit separates from the image holding unit; and a limiting unit that is provided between the displacement unit and the image holding unit and limits displacement of the continuous form paper on the image holding unit side when the displacement unit displaces the continuous form paper.

11. The image forming apparatus according to claim 10, wherein the position closer to the image holding unit when the transfer unit separates from the image holding unit is a position downstream of the transfer unit.

* * * * *